US007388506B2

(12) United States Patent
Abbott

(10) Patent No.: US 7,388,506 B2
(45) **Date of Patent: *Jun. 17, 2008**

(54) CLOSURE AND PACKAGE WITH INDUCTION SEAL AND RFID TAG

(75) Inventor: Douglas W. Abbott, Bowling Green, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 189 days.

This patent is subject to a terminal disclaimer.

(21) Appl. No.: 11/348,886

(22) Filed: Feb. 7, 2006

(65) Prior Publication Data

US 2007/0182564 A1 Aug. 9, 2007

(51) Int. Cl.
*G08B 13/14* (2006.01)

(52) U.S. Cl. ..... 340/572.8; 340/572.1

(58) Field of Classification Search ..... 340/572.8, 340/572.1

See application file for complete search history.

(56) References Cited

U.S. PATENT DOCUMENTS

| | | | | |
|---|---|---|---|---|
| 4,711,368 | A | 12/1987 | Simons | |
| 4,813,564 | A * | 3/1989 | Cooper et al. | 215/366 |
| 5,197,618 | A | 3/1993 | Goth | |
| 5,560,989 | A | 10/1996 | Han | |
| 5,566,441 | A | 10/1996 | Marsh et al. | |
| 5,720,401 | A | 2/1998 | Moore | |
| 6,137,413 | A * | 10/2000 | Ryan, Jr. | 340/572.8 |
| 6,474,490 | B1 | 11/2002 | Seibel et al. | |
| 6,641,052 | B2 * | 11/2003 | Choko et al. | 235/494 |
| 6,646,554 | B1 * | 11/2003 | Goff et al. | 340/572.6 |
| 6,667,092 | B1 | 12/2003 | Brollier et al. | |
| 6,782,601 | B2 | 8/2004 | Smeyak et al. | |
| 6,802,919 | B2 | 10/2004 | Massey et al. | |
| 6,859,745 | B2 | 2/2005 | Carr et al. | |
| 2002/0183883 | A1 | 12/2002 | Carr et al. | |
| 2002/0188259 | A1 | 12/2002 | Hickle et al. | |
| 2003/0061705 | A1 | 4/2003 | Smeyak et al. | |
| 2003/0061706 | A1 | 4/2003 | Smeyak et al. | |
| 2003/0235027 | A1 * | 12/2003 | Smeyak et al. | 361/679 |

(Continued)

FOREIGN PATENT DOCUMENTS

| | | |
|---|---|---|
| EP | 0619243 | 10/1994 |
| WO | WO 03/023705 A1 | 3/2003 |
| WO | WO 2006/016184 | 2/2006 |

*Primary Examiner*—Davetta W. Goins
*Assistant Examiner*—Kerri L McNally
(74) *Attorney, Agent, or Firm*—Reising, Ethington, Barnes, Kisselle, P.C.

(57) ABSTRACT

A package includes a container having a neck finish, and a closure having a plastic shell with a skirt externally secured to the container neck finish. A seal disk includes a metal layer on a plastic substrate. The periphery of the plastic substrate is sealingly secured to the neck finish of the container. The metal layer includes a circumferentially continuous outer periphery overlying the periphery of the plastic substrate and an inner portion structured as an rf antenna. An RFID tag is electrically connected at least to the inner portion of the metal layer. A liner disk may be disposed between the closure and the seal disk separate from the seal disk. The closure skirt may have an internal bead to engage the periphery of the liner disk and lift the liner disk off of the neck finish upon removal of the closure from the container neck finish.

13 Claims, 2 Drawing Sheets

U.S. PATENT DOCUMENTS

2004/0064362 A1 4/2004 Rosenfeld
2005/0128087 A1 6/2005 Claessens et al.
2005/0162277 A1 7/2005 Teplitxky et al.
2005/0184871 A1 8/2005 Coste
2006/0049948 A1* 3/2006 Chen et al. ..... 340/572.7
2006/0214789 A1* 9/2006 Posamentier et al. .... 340/545.6
2006/0255953 A1 11/2006 Lyon et al.
2007/0051691 A1* 3/2007 Hidding ..... 215/252
2007/0065609 A1* 3/2007 Korson ..... 428/34.1

* cited by examiner

CLOSURE AND PACKAGE WITH INDUCTION SEAL AND RFID TAG

The present disclosure relates to placement of a radio frequency identification (RFID) tag in a package to identify or confirm the genuineness of the package.

BACKGROUND AND SUMMARY OF THE DISCLOSURE

It is a general object of the present disclosure to provide a closure and container package that includes a seal disk induction or otherwise bonded to the neck finish of the container both to seal the package and to provide tamper indication, and an RFID tag coupled to a metal layer of the seal disk to confirm genuineness of the package and/or to provide information concerning the product within the package. Another and related object of the present disclosure is to provide a closure assembly that includes such a seal disk adapted to be applied to and sealed to the neck finish of a container following placement of product within the container.

The present disclosure embodies a number of aspects that can be implemented separately from or in combination with each other.

A package in accordance with one aspect of the present disclosure includes a container having a neck finish, and a closure having a plastic shell with a skirt externally secured to the container neck finish. A seal disk includes a metal layer on a plastic substrate. The periphery of the plastic substrate is sealingly secured to the neck finish of the container. The metal layer includes a circumferentially continuous outer periphery overlying the periphery of the plastic substrate and an inner portion structured as an rf antenna. An RFID tag is electrically connected at least to the inner portion of the metal layer. A liner disk may be disposed between the closure and the seal disk separate from the seal disk. The closure skirt may have an internal bead to engage the periphery of the liner disk and lift the liner disk off of the neck finish during removal of the closure from the container neck finish.

A closure in accordance with another aspect of the present disclosure includes a plastic shell having a skirt for securement to a container neck finish and a seal disk within the closure. The seal disk includes at least a metal layer and a plastic layer. The metal layer has a circumferentially continuous outer periphery overlying an outer periphery of the plastic layer, and an inner portion within the outer periphery contoured as an rf antenna. An RFID tag is disposed on the seal disk and electrically connected at least to the inner portion of the metal layer. The plastic layer preferably comprises a plastic disk substrate on which the metal layer is disposed. The closure may include a liner disk between the seal disk and the closure. The seal disk may be secured to the liner disk by an adhesion layer that is adapted to evaporate upon application of electrical energy to the metal layer to secure the seal disk to a container neck finish.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
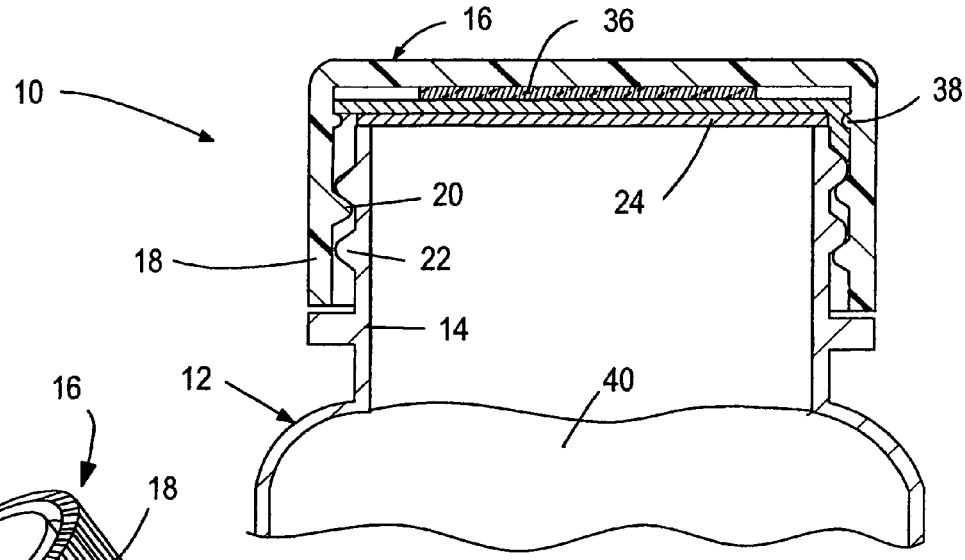
FIG. 1 is a fragmentary sectional view of a package in accordance with an exemplary embodiment of the present disclosure.
Figure 2:
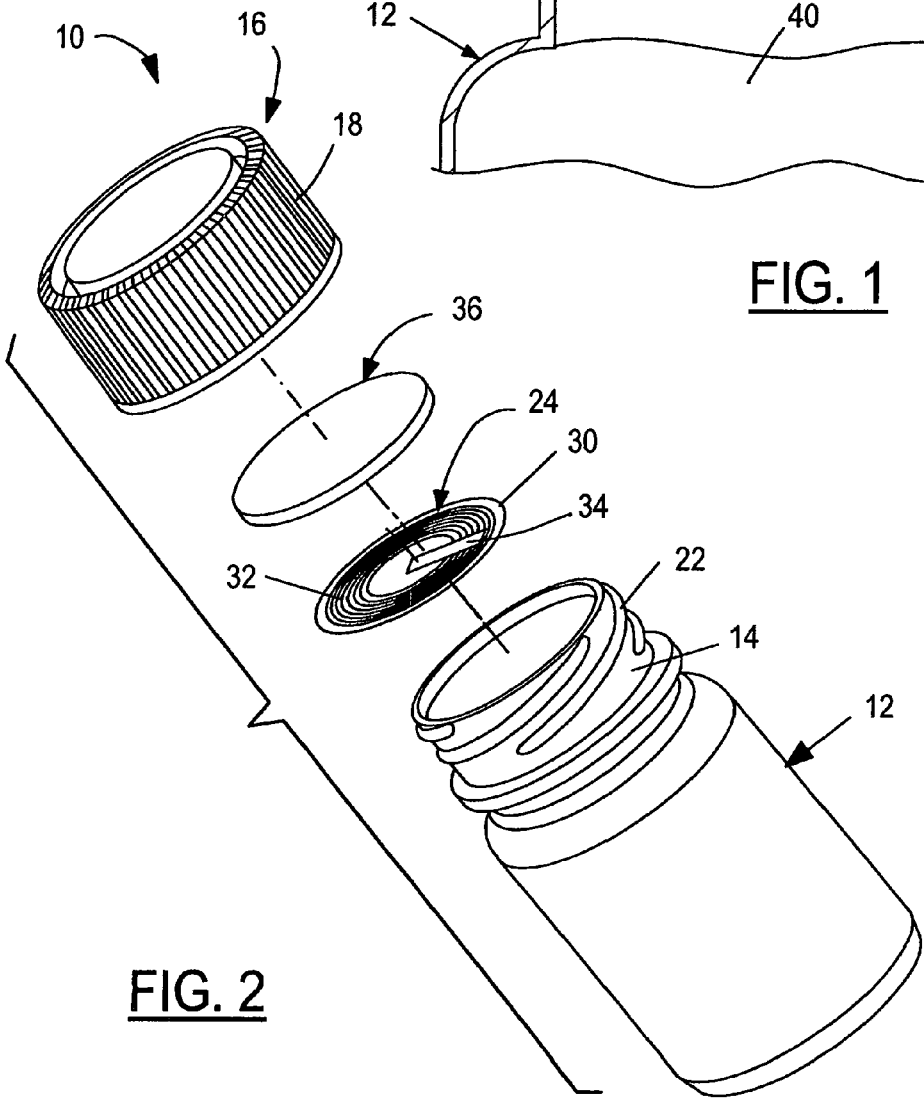
FIG. 2 is an exploded perspective view of the package illustrated in FIG. 1.
Figure 3:
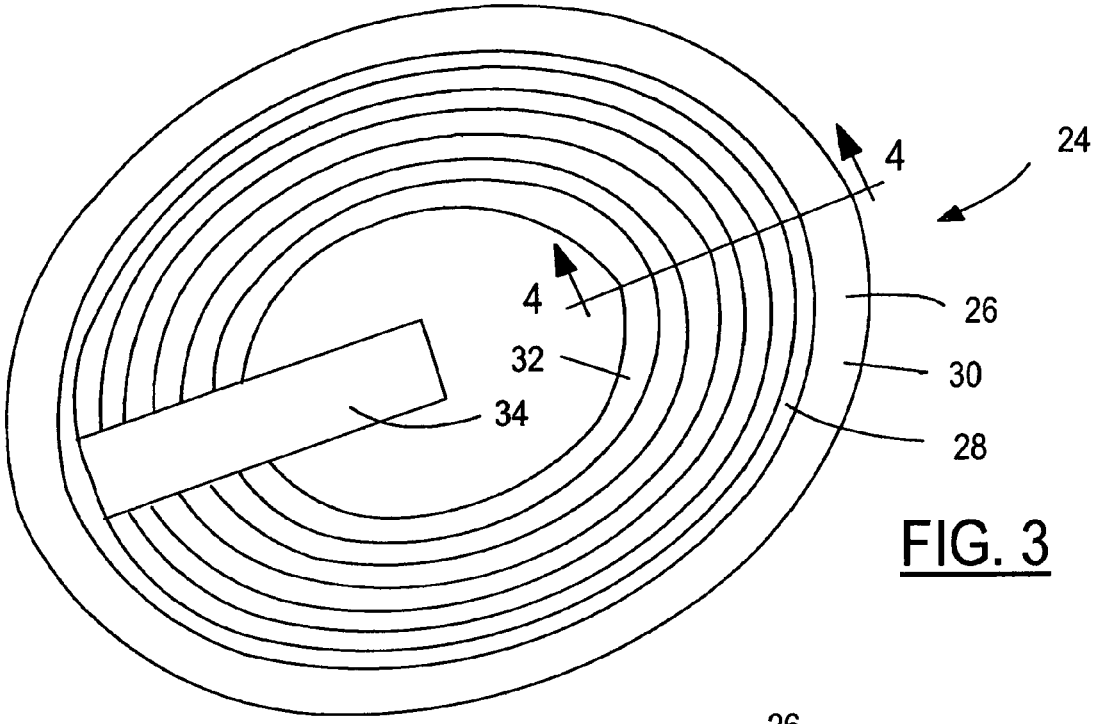
FIG. 3 is a perspective view of the seal disk in the package of FIGS. 1 and 2.
Figure 4:
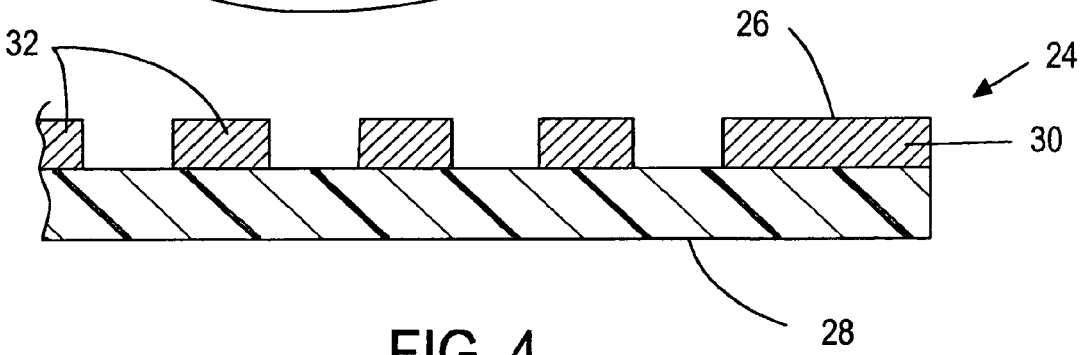
FIG. 4 is a fragmentary sectional view taken substantially along the line 4-4 in FIG. 3.

FIGS. 1-2 illustrate a package 10 in accordance with an exemplary embodiment of the present disclosure. Package 10 includes a container 12 having a neck finish 14. Neck finish 14 is illustrated as being cylindrical in the exemplary embodiment of the disclosure, but could be oval or of any other suitable geometry. A closure 16 includes a plastic shell with a skirt 18 having internal threads or beads 20 for engagement with external threads or beads 22 on neck finish 14 to secure the closure to the container. Skirt 18 preferably is cylindrical, and may be a peripheral skirt as illustrated on an inner skirt with an outer skirt of suitable geometry such as cylindrical or oval. The closure shell preferably is of molded plastic construction. Container 12 can be of any suitable construction, such as molded plastic or glass.

A seal disk 24 (FIGS. 1-4) includes at least a metal layer 26 deposited or otherwise disposed on a plastic substrate 28. Seal disk 24, including metal layer 26 and plastic substrate 28, preferably is of circular geometry corresponding to the preferred cylindrical geometry of container neck finish 14. Plastic substrate 28 preferably is of a material, such as polyethylene terephthalate (PET), a type of polyethylene (e.g., LDPE, MDPE or HDPE) or other suitable plastic, that can be induction bonded to the end of container neck finish 14. Metal layer 26, which may be of aluminum construction, includes a circumferentially continuous outer peripheral ring 30 that overlies the periphery of substrate 28, and an inner portion 32 that is etched or otherwise formed on substrate 28 in the structure of an rf antenna. Thus, the inner antenna portion 32 of metal layer 26 can include concentric rings, a continuous spiral or any other suitable geometry. An RFID microcircuit or tag 34 is disposed on layer 26 and electrically connected at least to the antenna portion 32 of layer 26. Thus, tag 34 can be interrogated from outside of the container through antenna 32 to obtain information from tag 34 to confirm genuineness of the package and/or to identify the product within the package such as for pricing or inventory control purposes. The structure of RFID tag 34 and the construction of the external circuitry for interrogating the RFID tag may be of any suitable type known in the art.

A liner disk 36 (FIGS. 1 and 2) optionally may be disposed between seal disk 24 and the closure shell. Liner disk 36 may be of any suitable construction, such as cellulose, to function as a liner to seal the package after seal disk 24 has been removed. Liner disk 36 may be retained within closure shell 16 by means of an internal bead 38 on closure skirt 18. Bead 38 can be circumferentially continuous or segmented. After placement of product 40 within container 12, seal disk 24 and closure 16, preferably including liner disk 36, are placed over the container neck finish. Seal disk 24 is then induction bonded or otherwise secured to the end of container neck finish 14. Induction bonding is facilitated by the circumferentially continuous outer peripheral ring 30 of metal layer 26 (FIGS. 3 and 4), which may form part of the rf antenna or may be separate from the antenna. The closed package, including RFID tag 34, can be interrogated to confirm genuineness of product 40 within the package or to identify the package and/or product such as by product type, lot number or the like. To open the package, closure 16 and liner disk 36 are removed, and seal disk 24 is ruptured to obtain access to the product within the package. Such rupturing of seal disk 24 not only provides a visual indication that the package has been opened, but also provides an electromagnetic indication that the package has been opened in that the antenna portion of the seal disk will have been ruptured so that tag 34 can no longer be interrogated.

Figure 5:
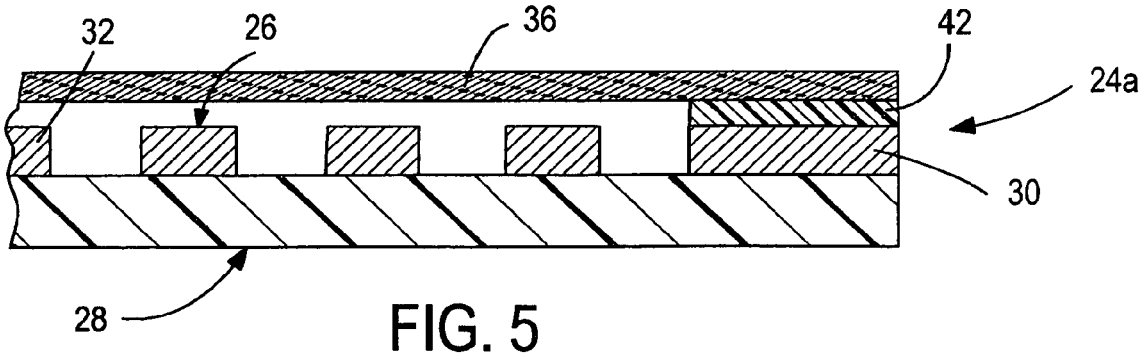
FIG. 5 is a fragmentary sectional view of a modification to the embodiment of FIG. 4.

FIG. 5 illustrates a seal disk 24*a* in which liner disk 36 is adhered at least to the outer periphery 30 of metal layer 26 by a layer 42 of material, such as wax, that evaporates upon application of electrical energy to ring 30. Thus, induction bonding of the seal disk to the container neck finish simultaneously functions in this embodiment to separate liner disk 36 from metal layer 26 so that the liner disk thereafter is removable with the closure while leaving the remainder of the seal disk in place on the container neck finish. This embodiment has the advantage that the subassembly of closure 16, liner disk 36 and seal disk 24 can be applied in one step, and liner disk 36 separated from seal disk 24 during the induction bonding operation. In the embodiment of FIGS. 1-4, seal disk 24 can be bonded to the container neck finish prior to assembly of closure 16 (with or without liner disk 36) to the container neck finish.

There thus have been disclosed a package and a closure, with an RFID tag mounted on a seal disk for induction bonding to the neck finish of the package, which fully satisfy all of the objects and aims previously set forth. The disclosure has been presented in conjunction with several exemplary embodiments, and other modifications and variations have been discussed. Additional modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A package that includes a container having a neck finish, and a closure that includes:

a plastic shell having a skirt externally secured to said neck finish, a seal disk that includes an electrically conductive layer on a plastic substrate, a periphery of said plastic substrate being sealingly secured to said neck finish, said electrically conductive layer including a circumferentially continuous outer periphery overlying said periphery of said plastic substrate and an inner portion within said outer periphery structured as an rf antenna, an RFID tag on said seal disk electrically connected at least to said inner portion of said electrically conductive layer, and a liner disk between said closure and said seal disk.

2. The package set forth in claim 1 wherein said liner disk is separate from said seal disk.

3. The package set forth in claim 2 including an internal bead on said skirt to engage a periphery of said liner disk and lift said liner disk off of said seal disk during removal of said closure from said neck finish.

4. A closure that includes:

a plastic shell having a skirt for securement to a container neck finish, a seal disk within said closure, said seal disk including at least an electrically conductive layer and a plastic layer, said plastic layer comprising a plastic disk substrate on which said electrically conductive layer is disposed, said electrically conductive layer including a circumferentially continuous outer periphery overlying an outer periphery of said plastic layer and an inner portion within said outer periphery contoured as an rf antenna, an RFID tag on said seal disk electrically connected at least to said inner portion of said electrically conductive layer, and a liner disk disposed between said seal disk and said closure.

5. The closure set forth in claim 4 wherein said seal disk is secured to said liner disk by an adhesion layer that is adapted to evaporate upon application of electrical energy to said outer periphery of said electrically conductive layer.

6. The closure set forth in claim 5 including an internal bead on said skirt to engage an outer periphery of said liner disk and hold said liner disk within said shell.

7. A closure that includes:

a plastic shell having a skirt for securement to a container neck finish, a seal disk within said closure, said seal disk including a plastic disk substrate and an electrically conductive layer disposed on said substrate, said electrically conductive layer including a circumferentially continuous outer periphery overlying a periphery of said plastic disk substrate and an inner portion within said outer periphery contoured as an rf antenna, an RFID tag on said seal disk electrically connected at least to said inner portion of said electrically conductive layer, and a liner disk disposed between said seal disk and said closure, said liner disk being secured at least to said continuous outer periphery of said electrically conductive layer by an adhesive layer that is adapted to evaporate upon application of electrical energy to said outer periphery of said electrically conductive layer.

8. The closure set forth in claim 7 including an internal bead on said skirt to engage an outer periphery of said liner disk and hold said liner disk within said shell.

9. A seal disk for placement in a closure and container package, which includes:

a plastic substrate disk having a circular outer periphery, an electrically conductive layer on said plastic substrate disk having a circumferentially continuous outer periphery overlying said outer periphery of said plastic substrate disk and an inner portion within said outer periphery structured as an rf antenna, said outer periphery of said plastic substrate disk underlying said outer periphery of said electrically conductive layer being adapted to melt and to bond said seal disk to a container neck finish upon application of electrical energy to said outer periphery of said electrically conductive layer, an RFID tag on said seal disk electrically connected at least to said inner portion of said electrically conductive layer, and a liner disk secured at least to said outer periphery of said electrically conductive layer by an adhesive layer that is adapted to evaporate upon application of electrical energy to said outer periphery of said electrically conductive layer to separate said liner disk from said electrically conductive layer.

10. The package set forth in claim 1 wherein said electrically conductive layer is of metal construction.

11. The closure set forth in claim 4 wherein said electrically conductive layer is of metal construction.

12. The closure set forth in claim 7 wherein said electrically conductive layer is of metal construction.

13. The seal disk set forth in claim 9 wherein said electrically conductive layer is of metal construction.

* * * * *